US007895857B2

(12) United States Patent
Inoue et al.

(10) Patent No.: US 7,895,857 B2
(45) Date of Patent: Mar. 1, 2011

(54) INDOOR UNIT OF AN AIR CONDITIONER

(75) Inventors: Kiyoshi Inoue, Kusatsu (JP); Katsuhiro Wakihara, Kusatsu (JP); Toshiaki Yamada, Kusatsu (JP); Ikuhiro Yamada, Kusatsu (JP); Shiro Kashiwa, Kusatsu (JP)

(73) Assignee: Daikin Industies, Ltd., Osaka (JP)

( * ) Notice: Subject to any disclaimer, the term of this patent is extended or adjusted under 35 U.S.C. 154(b) by 292 days.

(21) Appl. No.: 11/662,274

(22) PCT Filed: Sep. 9, 2005

(86) PCT No.: PCT/JP2005/016592

§ 371 (c)(1),
(2), (4) Date: Mar. 9, 2007

(87) PCT Pub. No.: WO2006/030703

PCT Pub. Date: Mar. 23, 2006

(65) Prior Publication Data

US 2008/0000249 A1 Jan. 3, 2008

(30) Foreign Application Priority Data

Sep. 13, 2004 (JP) ..... 2004-265407

(51) Int. Cl.
*F25D 19/00* (2006.01)
*F25D 23/12* (2006.01)
*F25D 17/06* (2006.01)

(52) U.S. Cl. ..... 62/298; 62/263; 62/426

(58) Field of Classification Search ..... 62/263, 62/426, 298
See application file for complete search history.

(56) References Cited

U.S. PATENT DOCUMENTS 4,410,033 A 10/1983 Wawro et al.

FOREIGN PATENT DOCUMENTS

| | | | |
|---|---|---|---|
| EP | 0 938 637 | B1 | 1/2003 |
| JP | 05-047721 | U | 6/1993 |
| JP | 05-172359 | A | 7/1993 |
| JP | 05-231673 | A | 9/1993 |
| JP | 07-324770 | A | 12/1995 |

*Primary Examiner* — Cheryl J Tyler
*Assistant Examiner* — Cassey Bauer
(74) *Attorney, Agent, or Firm* — Global IP Counselors

(57) ABSTRACT

An indoor unit of an air conditioner wherein a pipe retaining member retaining auxiliary piping connected to a heat exchanger is disposed near both a lateral side and an underside of a mounting frame. The pipe retaining member is bent in an L-shape, and its short plate is exposed on the underside of the mounting frame. The pipe retaining member can be removed only by slightly separating a lower part of the mounting frame from a wall in the fixed state of the indoor unit to the wall. Since the heat exchanger can be separated from the mounting frame without disconnecting the auxiliary piping from communication piping, maintenance work such as washing of the heat exchanger is efficiently performed without requiring much time and effort for separating the auxiliary piping from the communication piping.

8 Claims, 6 Drawing Sheets

INDOOR UNIT OF AN AIR CONDITIONER

CROSS-REFERENCE TO RELATED APPLICATIONS

This U.S. National stage application claims priority under 35 U.S.C. §119(a) to Japanese Patent Application No. 2004-265407, filed in Japan on Sep. 13, 2004, the entire contents of which are hereby incorporated herein by reference.

BACKGROUND OF THE INVENTION

The present invention relates to an indoor unit of an air conditioner, and in particular to a wall mounted type indoor unit of an air conditioner, which unit is mounted on a wall in a room.

Conventionally, this type of indoor unit of an air conditioner has a heat exchanger, a fan for leading room air to the heat exchanger, and a mounting frame on which the heat exchanger and the fan are mounted, wherein the back of the mounting frame is fixed to a wall surface in a room (see JP 5-47721 U, for example).

The heat exchanger is connected with auxiliary piping for supplying refrigerant to and discharging it from the heat exchanger. The auxiliary piping is led from the frontside of the mounting frame, on which the heat exchanger is mounted, to the backside of the mounting frame, and extends in a groove formed on the backside of the mounting frame. An end of the auxiliary piping is connected with an end of communication piping for supplying refrigerant to and discharging it from an outdoor unit. The communication piping is taken out from the indoor unit through an opening provided at a lateral side of the mounting frame, and is passed through a through-hole in a wall of a building and connected to an outdoor unit disposed outdoors.

The auxiliary piping extending in the groove of the mounting frame is fixed to the mounting frame with a pipe retaining member. The pipe retaining member is designed to be exposed only at the backside of the mounting frame and mounted on the backside of the mounting frame before the indoor unit is mounted on the wall.

However, the conventional indoor unit has a problem that maintenance such as cleaning of the heat exchanger requires much time and effort.

[In other words, the heat exchanger and the mounting frame must be separated to clean the heat exchanger. The heat exchanger is connected with the auxiliary piping which is fixed to the mounting frame with the pipe retaining member, so that the pipe retaining member must be removed from the mounting frame. However, because the pipe retaining member faces only the backside of the mounting frame, the indoor unit must be dismounted to expose the backside of the mounting frame in order to remove the pipe retaining member. In order to dismount the indoor unit from the wall, the auxiliary piping must be decoupled from the communication piping, which would require measures against refrigerant gas leakage from the piping, refilling refrigerant gas to compensate for such refrigerant gas leakage, or the like. This is why maintenance requires much time and effort.

SUMMARY OF THE INVENTION

It is therefore an object of the present invention to provide an indoor unit of an air conditioner for which maintenance operations can be efficiently performed with less time and effort.

In order to accomplish the above object, there is provided, according to the present invention, an indoor unit of an air conditioner, comprising:

a heat exchanger;

a fan for delivering air to the heat exchanger;

a mounting frame on which the heat exchanger and the fan are mounted, the mounting frame having a backside which is to be fixed to a wall;

piping connected to the heat exchanger to supply a heat transfer medium to and discharge the heat transfer medium from the heat exchanger; and a pipe retaining member disposed near a lateral side of the mounting frame and near an underside of the mounting frame to retain the piping.

In the above configuration, the pipe retaining member is disposed near the lateral side and the underside of the mounting frame, so that the pipe retaining member can be easily removed from the mounting frame in a state that the mounting frame is fixed to the wall. Thus, it is not necessary to dismount the whole of the indoor unit from the wall to remove the pipe retaining member unlike the conventional air conditioner indoor unit, so that time and effort for decoupling the auxiliary piping from the communication piping as required for the conventional indoor unit can be saved. Consequently, the heat exchanger and the mounting frame can be separated from each other without taking time for the piping decoupling, so that maintenance work such as cleaning of the heat exchanger can be performed effectively and efficiently without taking much time and trouble.

In one aspect, the piping has a bend and the pipe retaining member retains the piping by a portion near the bend.

In this aspect, the piping is retained by the pipe retaining member by a portion near the bend of the piping, and the pipe retaining member is positioned near both the lateral side and the underside of the mounting frame. The pipe retaining member can be easily removed from the mounting frame in a state that the mounting frame is fixed to the wall. Therefore, the mounting frame can be easily detached from the bend of the piping. Consequently, a lower part of the mounting frame including its underside can be easily detached from the wall in a state that an upper end of the mounting frame engages with the wall. In other words, the mounting frame can be swung around the upper end of the mounting frame.

In one aspect, a portion of the pipe retaining member is exposed on the literal side of the mounting frame.

In this aspect, the pipe retaining member can be easily removed from the mounting frame that is fixed to the wall.

In one aspect, the mounting frame includes an electrical component storage section for receiving electrical components, and a portion of the pipe retaining member is exposed to a lateral side of the electrical component storage section.

In this aspect, the pipe retaining member can be easily operated by removing the electrical components from the electrical component storage section.

In one aspect, the pipe retaining member is bent generally in an L shape, one end of the pipe retaining member has a backside engaging claw which engages with the backside of the mounting frame, the other end of the pipe retaining member has a side engaging claw which engages with the lateral side of the mounting frame, and a portion near the other end of the pipe retaining member is exposed on the lateral side of the mounting frame.

In this aspect, the portion near the other end of the pipe retaining member is exposed on the lateral side of the mounting frame, and the side engaging claw on this exposed end is easily disengaged from the corresponding lateral side of the mounting frame. Thus, the pipe retaining member can be easily removed from the mounting frame in the state that the mounting frame is fixed to the wall.

As described above, the indoor unit of the present invention has a heat exchanger, a fan for delivering air to the heat exchanger, a mounting frame on which the heat exchanger and the fan are mounted, the mounting frame having a backside which is to be fixed to a wall; piping connected to the heat exchanger to supply a heat transfer medium to and discharge the heat transfer medium from the heat exchanger, and a pipe retaining member disposed near a lateral side of the mounting frame and near an underside of the mounting frame to retain the piping. Therefore, the pipe retaining member can be easily removed from the mounting frame in a state that the mounting frame is fixed to the wall. Thus, it is not necessary to dismount the whole of the indoor unit from the wall to remove the pipe retaining member as in the conventional air conditioner indoor unit, so that time and effort for treating the piping as required for the conventional indoor unit can be saved. Consequently, the heat exchanger and the mounting frame can be separated from each other without taking time for the piping decoupling, so that maintenance work such as cleaning of the heat exchanger can be performed effectively and efficiently without taking much time and trouble.

BRIEF DESCRIPTION OF THE DRAWINGS

The present invention will become more fully understood from the detailed description given hereinbelow and the accompanying drawings which are given by way of illustration only, and thus are not intended to limit the present invention, and wherein.

DETAILED DESCRIPTION OF THE INVENTION

The present invention will be described in detail below according to the embodiments shown in the figures.

Figure 1:
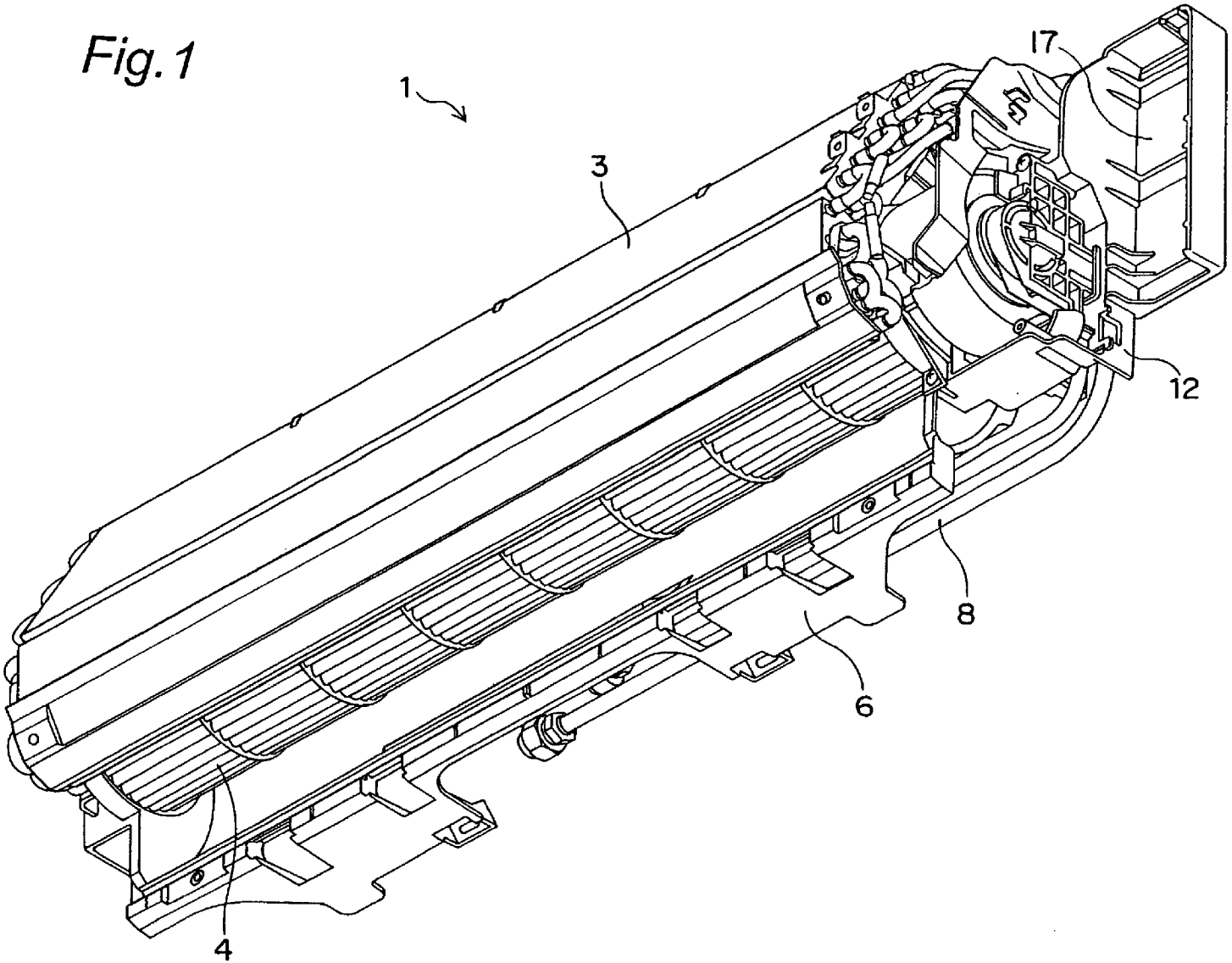
FIG. 1 is a perspective view of an indoor unit of an air conditioner as an embodiment of the present invention viewed from the lower front.
Figure 2:
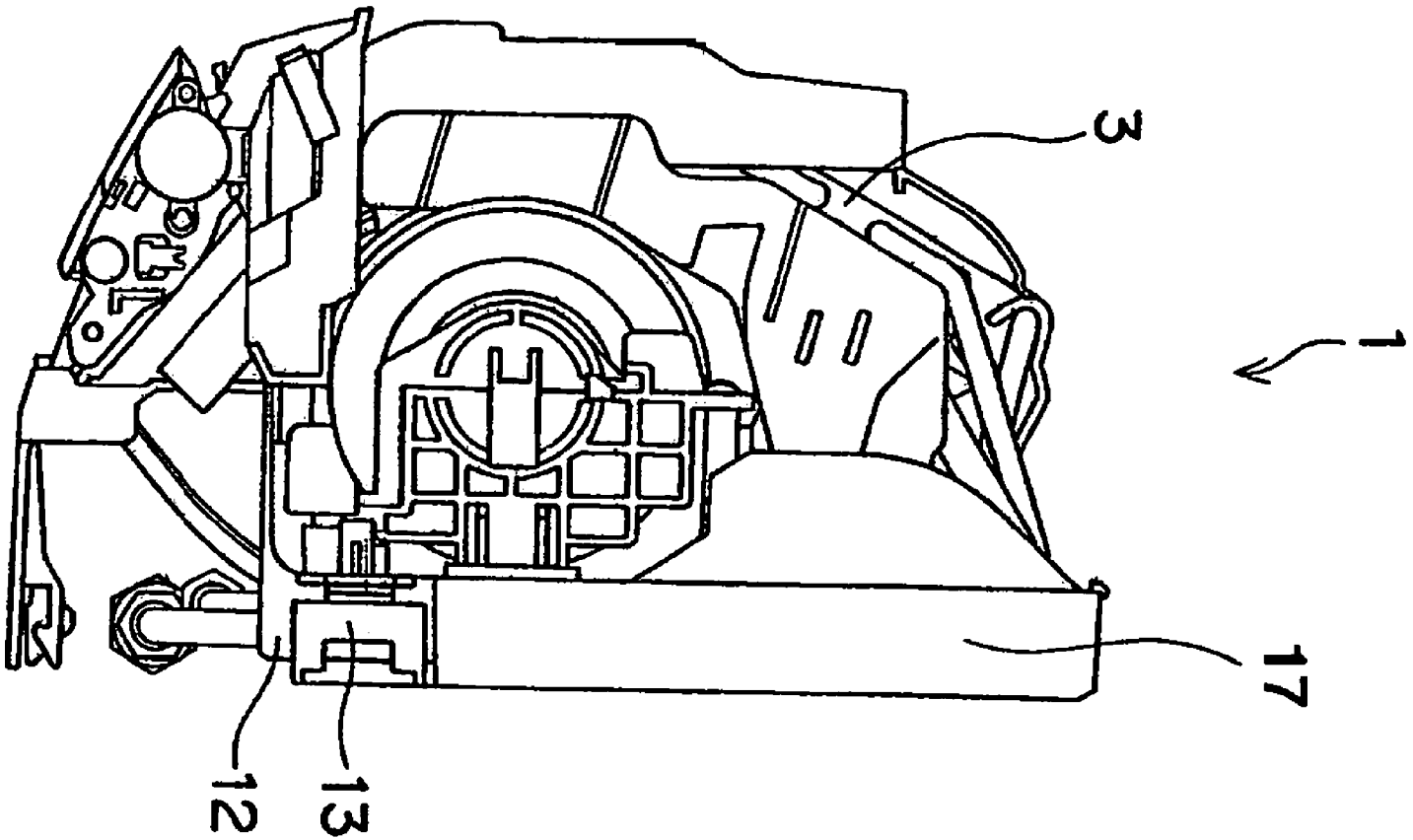
FIG. 2 is a side view of the indoor unit.
Figure 3:
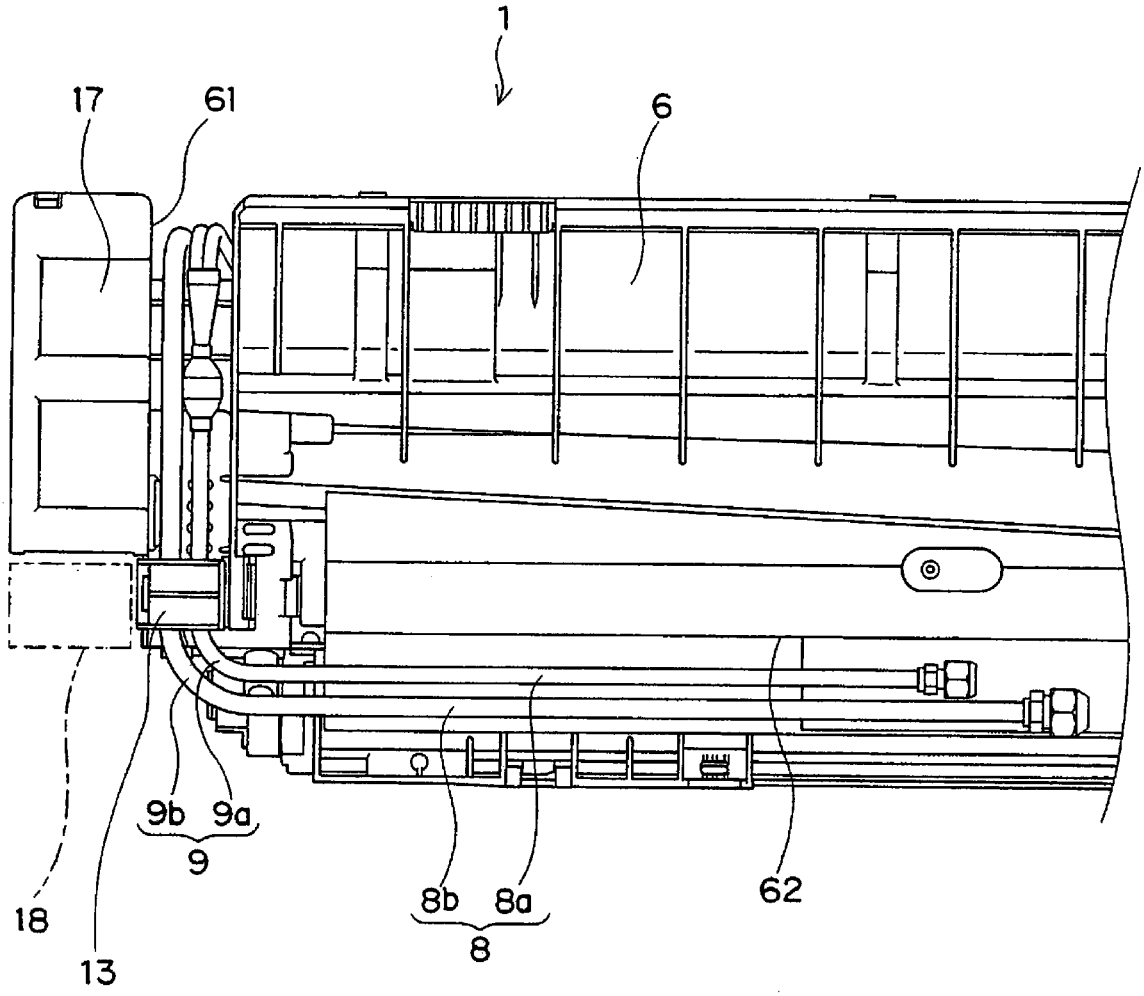
FIG. 3 is a back view of the indoor unit.
Figure 4:
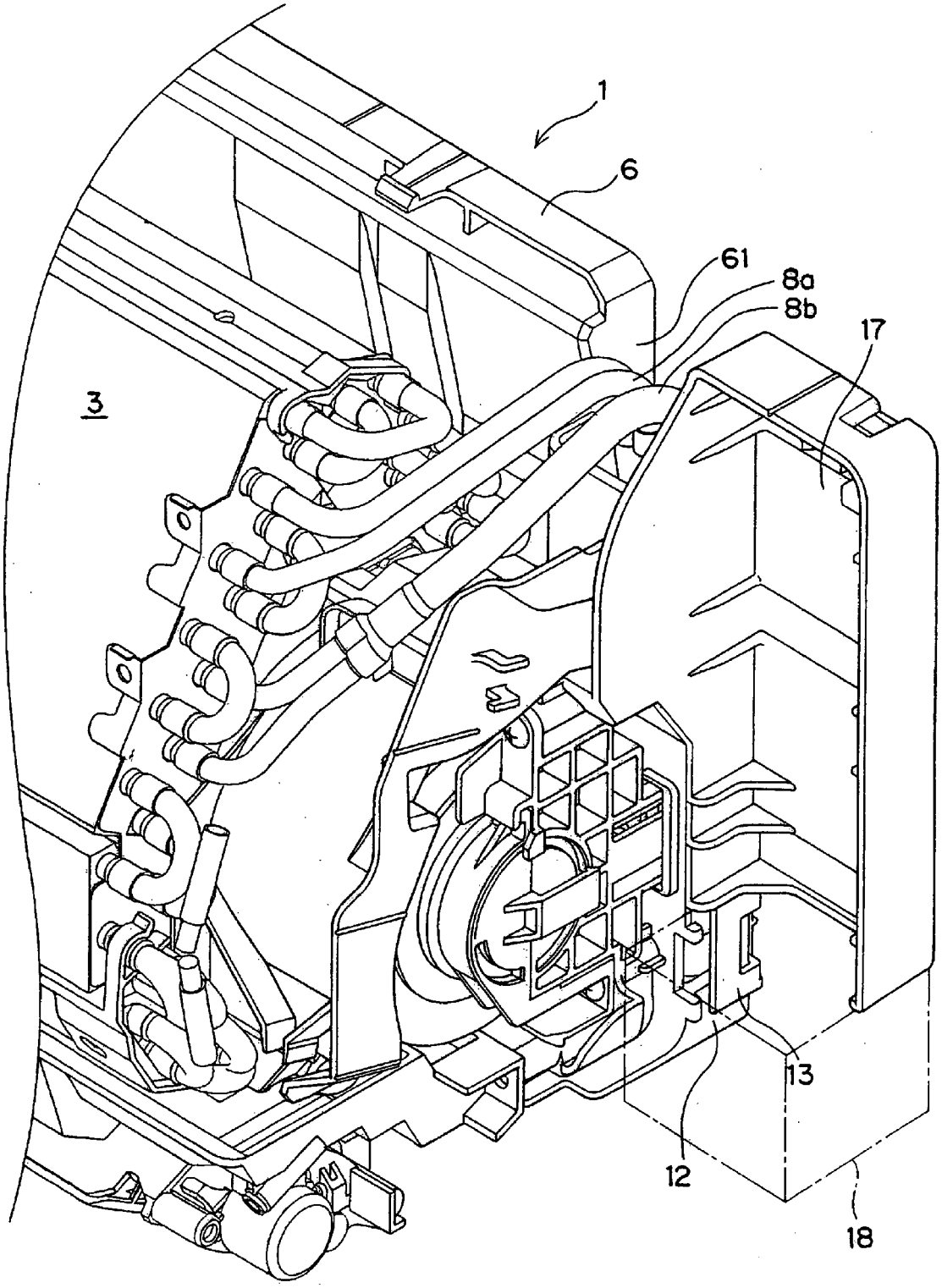
FIG. 4 is an enlarged perspective view of a portion including a lateral side of the indoor unit.

FIG. 1 is a perspective view of an indoor unit of an air conditioner as an embodiment of the present invention viewed from the lower front, FIG. 2 is a side view of the indoor unit, FIG. 3 is a back view of the indoor unit, and FIG. 4 is an enlarged perspective view of a portion near a side of the indoor unit. In FIGS. 1 to 4, parts such as a front cover for covering the front face of the indoor unit are not shown.

The air conditioner indoor unit 1 has a heat exchanger 3 for performing heat exchange between refrigerant as a heat transfer medium and room air, and a mounting frame 6 on which the heat exchanger 3 is mounted. In addition to the heat exchanger 3, a fan 4 for delivering the room air to the heat exchanger 3, a motor for driving the fan 4, a flap for changing the direction of air flow caused by the fan 4, a motor for driving the flap, etc. are mounted on the mounting frame 6. Near the right side of the mounting frame 6 when viewed from the front of the indoor unit 1, there is provided a storage section for storing electrical components which constitute a power supply circuit and a control circuit of the air conditioner.

The front cover not shown in the figures has an air inlet for sucking room air through an air filter into the indoor unit, and an air outlet for supplying air conditioned by the indoor unit to the room. Part of a wall defining an air path ranging between the air inlet and the air outlet is formed from a portion of the frontside of the mounting frame. The heat exchanger 3 and the fan 4 are disposed in the air path.

On the backside of the mounting frame 6, an engaging section for fixing the mounting frame 6 to a wall is formed. In other words, a mounting plate is fixed to the surface of the wall on which the indoor unit is to be mounted, and the engaging section on the backside of the mounting frame 6 is engaged with the mounting plate to fix the mounting frame 6 to the wall.

Also, a vertical groove 61 extending in the vertical direction is formed on the left side of the backside of the mounting frame 6 when viewed from the back of the mounting frame as shown in FIG. 3. Furthermore, a horizontal groove 62 extending in the horizontal direction is formed near the lower end of the mounting frame 6.

In the vertical groove 61 and the horizontal groove 62, auxiliary piping 8 as piping connected with the heat exchanger 3 is accommodated. The auxiliary piping 8 consists of a supply pipe 8*a* for supplying a refrigerant to the heat exchanger 3 and a discharge pipe 8*b* for discharging the refrigerant from the heat exchanger 3, and is covered with a heat insulating tube not shown in the figures. The auxiliary piping 8 is brazed to the right side of the heat exchanger when viewed from the front of the heat exchanger. The auxiliary piping 8 extends from the right side of the heat exchanger 3 to the backside of the mounting frame 6 to enter the upper end of the vertical groove 61, and further extends from the upper end of the vertical groove 61 to the lower end of it. The supply pipe 8*a* and discharge pipe 8*b* of the auxiliary piping include bends 9*a* and 9*b*, respectively, which are bent toward the right when viewed from the back of the mounting frame 6, in positions just outside the lower end of the vertical groove 61. A portion near and above the bend 9 of the auxiliary piping 8 is held and fixed with a pipe retaining member 13. A portion on the right of the bend 9 of the auxiliary piping 8 in FIG. 3 extends in the horizontal groove 62 to the right when viewed from the back of the mounting frame 6. In the horizontal groove 62, the auxiliary piping 8 is connected to communication piping not shown in the figures. The communication piping gets out of the indoor unit on its right side when viewed from the front of the indoor unit, passes through a through-hole formed in the wall, and is connected with an outdoor unit disposed outdoors.

Figure 5:
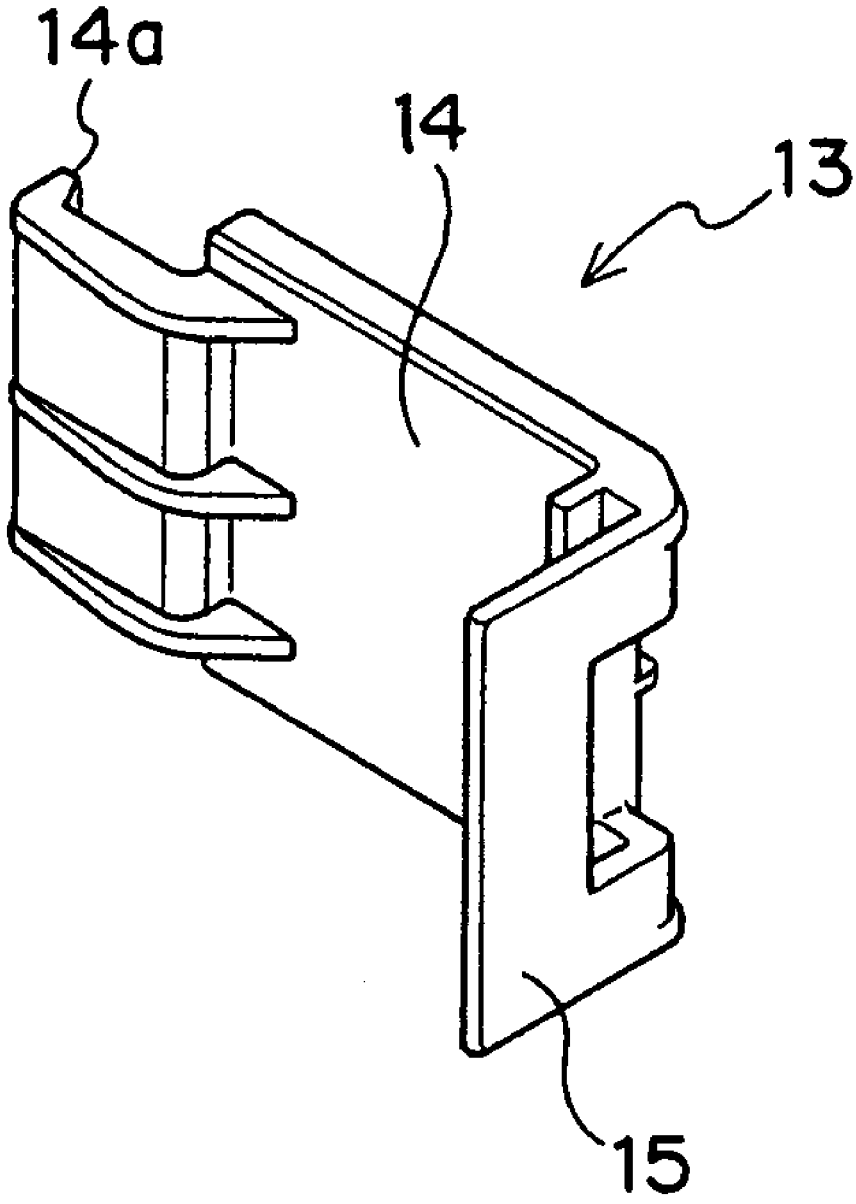
FIG. 5 is a perspective view showing a pipe retaining member.
Figure 6A:
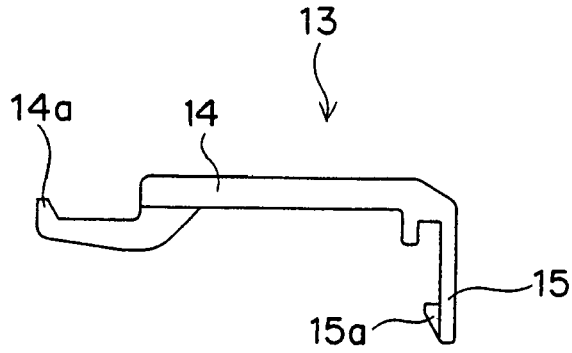
FIG. 6A is a plan view of the pipe retaining member.
Figure 6B:
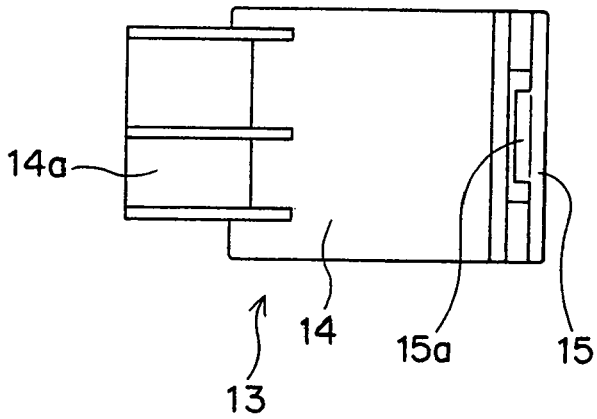
FIG. 6B is a back view of the pipe retaining member.
Figure 6C:
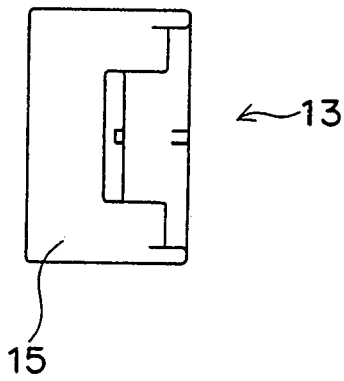
FIG. 6C is a side view of the pipe retaining member.

FIG. 5 is a perspective view showing the pipe retaining member 13, and FIGS. 6A, 6B, and 6C are a plan view, a back view, and a side view of the pipe retaining member 13, respectively. As shown in FIG. 5 and FIGS. 6A to 6C, the pipe retaining member 13 is bent generally in the shape of the letter L, and has a long plate 14 and a short plate 15 which form a substantially right angle. The tip of the long plate 14 is formed with a backside engaging claw 14*a* which engages with the backside of the mounting frame 6 is formed, and the tip of the short plate 15 is formed with a side engaging claw 15*a* which engages with a lateral side of the mounting frame 6 is formed.

As shown in the side view of FIG. 2 and the back view of FIG. 3, the pipe retaining member 13 is positioned near the left side of the mounting frame when viewed from the back of the mounting frame 6 and near the underside of the mounting frame. While the pipe retaining member 13 is mounted on the mounting frame 6, the long plate 14 is exposed on the backside of the mounting frame 6, and the short plate 15 is exposed on the left side of the mounting frame when viewed from the back of the mounting frame 6.

The perspective view of FIG. 1 shows the indoor unit in the state that the pipe retaining member 13 has been removed, and an engaging section 12 which engages with the short plate 15 is formed on the right side of the mounting frame 6 when viewed from the front of the mounting frame 6. The engaging section 12 is provided with an engaging hole which receives, or engages with the side engaging claw 15*a* of the short plate 15.

The engaging section 12 faces a storage section for electrical components which is positioned near the right side of the mounting frame 6. In other words, an electrical component box engaging section 17 is formed near the right side of the mounting frame 6, and an electrical component box is engaged with and stored in the electrical component box engaging section 17. When the electrical component box, not shown in the figures, is placed in the electrical component box engaging section 17, a lower part 18 of the electrical component box projects downwards from the electrical component box engaging section 17 as shown with a broken line in FIG. 3. The engaging section 12 and the short plate 15 of the pipe retaining member which engages with the engaging section 12 are designed to be exposed to a lateral side of the electrical component storage section including a portion into which the electrical component box projects. Because of this, the short plate 15 of the pipe retaining member is hidden by the electrical component box when the latter is placed in position.

Furthermore, near the lower end of the vertical groove 61, the mounting frame 6 has an engaging hole adjacent to an edge of the vertical groove 61, and the backside engaging claw 14*a* of the pipe retaining member is adapted to engage with the engaging hole.

Maintenance work such as cleaning of the heat exchanger 3 of the air conditioner indoor unit as configured above can be performed in a state that the mounting frame 6 is fixed to a wall in a room, as described below.

First, the front cover, not shown in the figures, is removed to expose the heat exchanger 3 and the electrical component box. In addition, bolts with which the lower end of the mounting frame 6 is fixed to the lower end of the mounting plate are removed. Since the upper end of the mounting frame 6 is engaged with the upper end of the mounting plate, there is not a fear of a fall of the indoor unit even if the bolts are removed.

Next, the electrical component box exposed is removed from the electrical component box engaging section 17 of the mounting frame 6 to expose the short plate 15 of the pipe retaining member to the side of the electrical component storage section. The end of the short plate 15 exposed is bent outside to disengage the side engaging claw 15*a* of the short plate from the engaging hole of the engaging section 12. Because of this, engagement of the short plate 15 with the engaging section 12 is released.

Next, a lower part of the mounting frame 6 including its underside is separated on the order of one centimeter from the wall surface to make a slight clearance between the lower part of the mounting frame 6 and the wall surface. Then, the pipe retaining member 13 is moved toward the wall within the clearance, and thereby engagement of the backside engaging claw 14*a* of the long plate of the pipe retaining member with the engaging hole of the backside of the mounting frame 6 is released. Thus, the pipe retaining member 13 can be easily removed from the mounting frame 6 through the clearance.

After removing the pipe retaining member 13, screws with which the heat exchanger 3 is fixed to the mounting frame 6 are removed, and then the mounting frame 6 the upper end of which engages with the mounting plate is dismounted from the wall. At this time, since the pipe retaining member 13 has been removed, the auxiliary piping 8 connected with the heat exchanger 3 can be easily taken out of the grooves 61 and 62 of the mounting frame 6. Because of this, the mounting frame 6 can be easily separated from the heat exchanger 3, auxiliary piping 8, and communication piping which are connected with each other, and is this easily dismounted from the wall. By dismounting the mounting frame 6 from the wall, the communication piping which runs through the through-hole of the wall, and the auxiliary piping 8 and the heat exchanger 3, which are connected with the communication piping, are exposed and left near the wall surface. Consequently, the maintenance work such as cleaning of the heat exchanger 3 can be performed without decoupling the auxiliary piping 8 from the communication piping. With respect to the mounting frame 6 which has been dismounted from the wall, maintenance works, such as washing of the drain pan mounted on the mounting frame 6 and cleaning and/or repair of the fan mounted on the mounting frame 6, can be performed.

As described above, in the air conditioner indoor unit of this embodiment, the pipe retaining member 13 can be removed with the mounting frame 6 being fixed to a wall, so that it is not necessary to dismount the whole of the indoor unit including the heat exchanger 3 and the auxiliary piping 8 from the wall. Thus, it is not necessary to decouple the auxiliary piping 8 from the communication piping in order to dismount the whole of the indoor unit from the wall, whereby it is possible to save time and effort which would be required for work of preventing refrigerant leakage, work of supplying additional refrigerant to compensate for refrigerant leakage, etc. if the auxiliary piping 8 should be decoupled from the communication piping. Furthermore, since the auxiliary piping 8 is not decoupled from the communication piping, there is also no occurrence of room air pollution caused by refrigerant leakage during the decoupling work. Because of this, maintenance work such as cleaning of the heat exchanger 3 of the air conditioner indoor unit can be effectively and efficiently performed without much time and effort.

In this connection, it is not always necessary to dismount the mounting frame 6 from the wall. For example, the mounting frame 6 may be swung around the upper end engaged with the mounting plate to perform the maintenance work of the backside of the mounting frame 6. What is important is that all works which have been made possible by easy separation between the auxiliary piping 8 and the mounting frame 6 can be done in the state that the mounting frame 6 is fixed to the wall.

Also, in this embodiment, the position where the pipe retaining member 13 retains the auxiliary piping 8 is not limited to a position above the bend 9 of the auxiliary piping, and may be any other position near the bend 9. Furthermore, the short plate 15 of the pipe retaining member 13 may not be exposed on a lateral side of the electrical component storage section, but may be disposed only near a lateral side of the mounting frame 6 and near the underside of it.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An indoor unit of an air conditioner, comprising:

a heat exchanger;

a fan for delivering air to the heat exchanger;

a mounting frame on which the heat exchanger and the fan are mounted, the mounting frame having a backside configured to be fixed to a wall, an upperside facing upwardly when the backside is fixed to the wall, an underside facing downwardly when the backside is fixed to the wall, the underside including a lowermost surface of the mounting frame, and first and second sides disposed at opposite ends of the backside, the upperside and the underside;

an electrical component storage section provided on one side of the first side of the mounting frame to receive electrical components;

piping connected to the heat exchanger to supply a heat transfer medium to and discharge the heat transfer medium from the heat exchanger, the piping extending on the backside of the mounting frame adjacent the first side of the mounting frame, the piping including an upright section extending along the first side of the mounting frame between the upperside and underside of the mounting frame and between the first side of the mounting frame and the electrical component storage section, a lateral section extending along the underside of the mounting frame, and a bend section disposed between the lateral and upright sections; and a pipe retaining member disposed at the first side of the mounting frame adjacent to and upwardly of the underside of the mounting frame to retain the piping such that a first portion of the pipe retaining member is exposed on the backside of the mounting frame and a second portion of the pipe retaining member is exposed on the first side of the mounting frame, the pipe retaining member and the mounting frame being arranged and configured such that the pipe retaining member is removable from the mounting frame while the mounting frame is fixed to the wall, and the pipe retaining member is located above the lateral section and the bend of the piping when backside is fixed to the wall and the pipe retaining member is retaining the piping so the piping retaining member retains the upright section of the piping.

2. The indoor unit as claimed in claim 1, wherein the pipe retaining member retains the piping adjacent the bend.

3. The indoor unit as claimed in claim 1, wherein the second portion of the pipe retaining member is movable with respect to the mounting frame to disengage the second portion of the pipe retaining member from the mounting frame.

4. The indoor unit as claimed in claim 1, wherein an electrical component box containing the electrical components is removably stored in the electrical component storage section, and the second portion of the pipe retaining member faces the electrical component box while the electrical component box is stored in the electrical component storage section.

5. The indoor unit as claimed in claim 1, wherein the first and second portions of the pipe retaining member extend in an upright direction along the upright section when the backside is fixed to the wall and the pipe retaining member is retaining the piping.

6. An indoor unit of an air conditioner, comprising:

a heat exchanger;

a fan for delivering air to the heat exchanger;

a mounting frame on which the heat exchanger and the fan are mounted, the mounting frame having a backside configured to be fixed to a wall, an upperside facing upwardly when the backside is fixed to the wall, an underside facing downwardly when the backside is fixed to the wall, the underside including a lowermost surface of the mounting frame, and first and second sides disposed at opposite ends of the backside, the upperside and the underside;

an electrical component storage section provided on one side of the first side of the mounting frame to receive electrical components;

piping connected to the heat exchanger to supply a heat transfer medium to and discharge the heat transfer medium from the heat exchanger, the piping extending on the backside of the mounting frame adjacent the first side of the mounting frame, the piping including an upright section extending along the first side of the mounting frame between the upperside and underside of the mounting frame and between the first side of the mounting frame and the electrical component storage section, a lateral section extending along the underside of the mounting frame, and a bend section disposed between the lateral and upright sections; and a pipe retaining member disposed at the first side of the mounting frame adjacent to and upwardly of the underside of the mounting frame to retain the piping, the pipe retaining member being generally L-shaped with a first portion extending to one end having a backside engaging claw releasably engaged with the backside of the mounting frame, a second portion extending to another end having a side engaging claw releasably engaged with the first side of the mounting frame, the pipe retaining member being located above the lateral section and the bend of the piping when backside is fixed to the wall and the pipe retaining member is retaining the piping so the pipe retaining member retains the upright section of the piping and the second portion of the pipe retaining member being exposed on the first side of the mounting frame with the second portion of the pipe retaining member being movable with respect to the mounting frame to disengage the second portion of the pipe retaining member from the mounting frame.

7. The indoor unit as claimed in claim 6, wherein an electrical component box containing the electrical components is removably stored in the electrical component storage section, and the second portion of the pipe retaining member faces the electrical component box while the electrical component box is stored in the electrical component storage section.

8. The indoor unit as claimed in claim 6, wherein the first and second portions of the pipe retaining member extend in an upright direction along the upright section when the backside is fixed to the wall and the pipe retaining member is retaining the piping.

* * * * *